US010508455B1

(12) United States Patent
Bredeweg

(10) Patent No.: US 10,508,455 B1
(45) Date of Patent: Dec. 17, 2019

(54) CHANNELED PLANK SIDING

(71) Applicant: QUALITY EDGE, INC., Walker, MI (US)

(72) Inventor: Mark Allen Bredeweg, Zeeland, MI (US)

(73) Assignee: QUALITY EDGE, INC., Walker, MI (US)

( * ) Notice: Subject to any disclaimer, the term of this patent is extended or adjusted under 35 U.S.C. 154(b) by 0 days.

(21) Appl. No.: 16/216,107

(22) Filed: Dec. 11, 2018

(51) Int. Cl.
*E04F 13/08* (2006.01)
*E04F 13/12* (2006.01)

(52) U.S. Cl.
CPC ..... *E04F 13/0869* (2013.01); *E04F 13/0864* (2013.01); *E04F 13/0889* (2013.01); *E04F 13/12* (2013.01)

(58) Field of Classification Search
CPC ... E04F 13/0869; E04F 13/0864; E04F 13/12; E04F 13/088
See application file for complete search history.

(56) References Cited

U.S. PATENT DOCUMENTS 2,258,247 A * 10/1941 Hull ..... E04F 13/0864 52/530
2,591,361 A * 4/1952 Knott ..... E04F 13/0814 52/489.1
2,642,968 A * 6/1953 Roush ..... E04F 13/0803 52/520
3,188,774 A 6/1965 McCorkle
3,325,952 A 6/1967 Trachtenberg
3,473,274 A * 10/1969 Godes ..... E04F 13/0864 52/127.5
4,102,106 A * 7/1978 Golder ..... E04F 13/0864 52/533
4,122,643 A * 10/1978 Hafner ..... E04F 13/0864 52/520
4,327,528 A * 5/1982 Fritz ..... E04B 1/7612 52/309.1
4,593,512 A * 6/1986 Funaki ..... E04F 13/0864 52/519
5,016,415 A * 5/1991 Kellis ..... E04F 13/0864 52/522
5,363,623 A * 11/1994 King ..... B29D 99/001 52/520
5,560,170 A * 10/1996 Ganser ..... E04F 13/0864 52/212
5,581,970 A * 12/1996 O'Shea ..... E06B 1/62 52/204.53
5,598,677 A * 2/1997 Rehm, III ..... E04D 1/265 52/309.9
5,694,728 A * 12/1997 Heath, Jr. ..... E04D 3/32 52/518
5,862,912 A * 1/1999 Schelhorn ..... B65D 67/02 206/321
5,878,543 A * 3/1999 Mowery ..... E04F 13/0864 52/519

(Continued)

*Primary Examiner* — Joshua K Ihezie
(74) *Attorney, Agent, or Firm* — Price Heneveld LLP

(57) ABSTRACT

A building siding panel is provided with an internal channel for weeping away water and the ability to hide the securing flange when the siding panel is installed on a building wall. The siding panel can be customized to have the look of a wooden panel, while retaining the benefits and durability of a non-wooden material, such as metal.

19 Claims, 8 Drawing Sheets

(56) References Cited

U.S. PATENT DOCUMENTS

| | | | | |
|---|---|---|---|---|
| 6,223,488 | B1 * | 5/2001 | Pelfrey | E04D 13/152 52/302.1 |
| 6,295,777 | B1 * | 10/2001 | Hunter | E04F 13/0864 52/311.1 |
| 6,988,345 | B1 * | 1/2006 | Pelfrey | E04F 13/0864 52/519 |
| 7,040,067 | B2 * | 5/2006 | Mowery | E04F 13/0864 52/309.8 |
| 8,006,455 | B1 | 8/2011 | Mollinger et al. | |
| 8,336,269 | B1 * | 12/2012 | Mollinger | E04F 13/007 428/167 |
| 8,381,472 | B1 | 2/2013 | Fleenor | |
| 9,068,362 | B1 | 6/2015 | Baxter et al. | |
| 2006/0053715 | A1 * | 3/2006 | Mowery | E04F 13/0864 52/309.8 |
| 2006/0075712 | A1 * | 4/2006 | Gilbert | B32B 5/18 52/520 |
| 2008/0141607 | A1 * | 6/2008 | Stoecker | E04F 13/12 52/478 |
| 2009/0126286 | A1 * | 5/2009 | Sigmund | E04D 13/152 52/95 |
| 2009/0301015 | A1 | 12/2009 | Simms | |
| 2010/0064611 | A1 * | 3/2010 | Holt | E04C 2/243 52/309.4 |
| 2016/0153197 | A1 * | 6/2016 | Baum, Jr. | B21D 5/08 428/18 |

* cited by examiner

CHANNELED PLANK SIDING

BACKGROUND

The present invention generally relates to modular plank siding and, more specifically, to modular plank siding that incorporates an internal drainage system.

BRIEF SUMMARY OF THE INVENTION

One aspect of the present invention includes a siding panel to be attached to a building. The siding panel has an elongated body with an inner face and an outer face. A securing flange is located near the upper end of the siding panel and is in a generally horizontal orientation when the siding panel is attached to the surface of a building. The securing flange portion also has a plurality of fastener openings. The securing flange is spaced away from the outer face of the elongated body of the siding panel a first distance, spacing the inner face of the siding panel a distance away from the side of the building. The siding panel includes a receiving channel located near the bottom of the securing flange. A tab portion is located near the lower end of the elongated body of the siding panel. The tab portion is also in a generally horizontal orientation when the siding panel is attached to a surface of a building. The tab portion is spaced away from the outer face of the elongated body a second distance, which is less than the first distance. The siding panel includes an inner channel formed by an inclined surface between the inner face of the elongated body and the tab portion. The inner channel includes one or more weep holes. A first inclined edge located near the upper end of the elongated body such that when panels are placed vertically adjacent each other, the weep holes of the top panel are positioned above an inclined edge of the lower adjacent elongated panel to divert water away from the building.

In another aspect, the invention includes a building siding system. The siding panel has an elongated body with a generally horizontal upper end and a generally horizontal lower end when the siding panel is secured in a generally horizontal orientation to the building wall. The elongated body has an outer face oriented away from the building wall and an inner face oriented toward the building wall. A securing flange extends from the siding panel with a plurality of fastener openings. The securing flange is spaced away from the outer face of the elongated body a first distance. Fasteners are secured through the fastener openings to attach the siding panel to the building wall. The siding panel includes a receiving channel located between a portion of the securing flange and a generally vertical portion of the siding panel spaced away from the securing flange, the bottom of the receiving channel being generally U-shaped. The siding panel includes a tab portion located near the generally horizontal lower end of the elongated body, with the tab portion being spaced away from the outer face of the elongated body a second distance. The panel includes an inner channel formed by a second inclined surface that extends from the bottom of the generally horizontal lower end to the top of the tab portion. The first inclined surface extends from the generally horizontal upper end toward a portion of the securing flange. Weep holes are positioned in the lower end of the inner channel. The distance between the tab portion and the elongated body is smaller than the distance between the securing flange and the elongated body.

In yet a further aspect, the invention includes a siding panel with an elongated body having an upper end, a lower end, an outer face, and an inner face. A securing flange is positioned in a generally parallel manner to the outer face, with an upper portion having a plurality of fastener openings. The upper portion of the securing flange extends vertically parallel to and above the upper end of the elongated body. The securing flange also includes a downward portion that extends generally parallel to and below a portion of the upper end of the elongated body. A receiving channel is formed between the downward portion of the securing flange and a wall that is generally parallel to the downward portion of the securing flange to create a channel with the generally U-shaped bottom. A tab portion is positioned in a generally parallel manner to the outer face of the elongated body. The tab portion includes an upper end portion that extends generally parallel to and above the lower end of the elongated body and a lower end portion that extends generally parallel to and below the lower end of the elongated body. An inner channel is formed between an inclined surface extending from the lower end of the elongated body to the upper end of the tab portion. A plurality of weep holes are located in the inner channel.

These and other features, advantages, and objects of the present invention will be further understood and appreciated by those skilled in the art by reference to the following specification, claims, and appended drawings.

DETAILED DESCRIPTION

Figure 1:
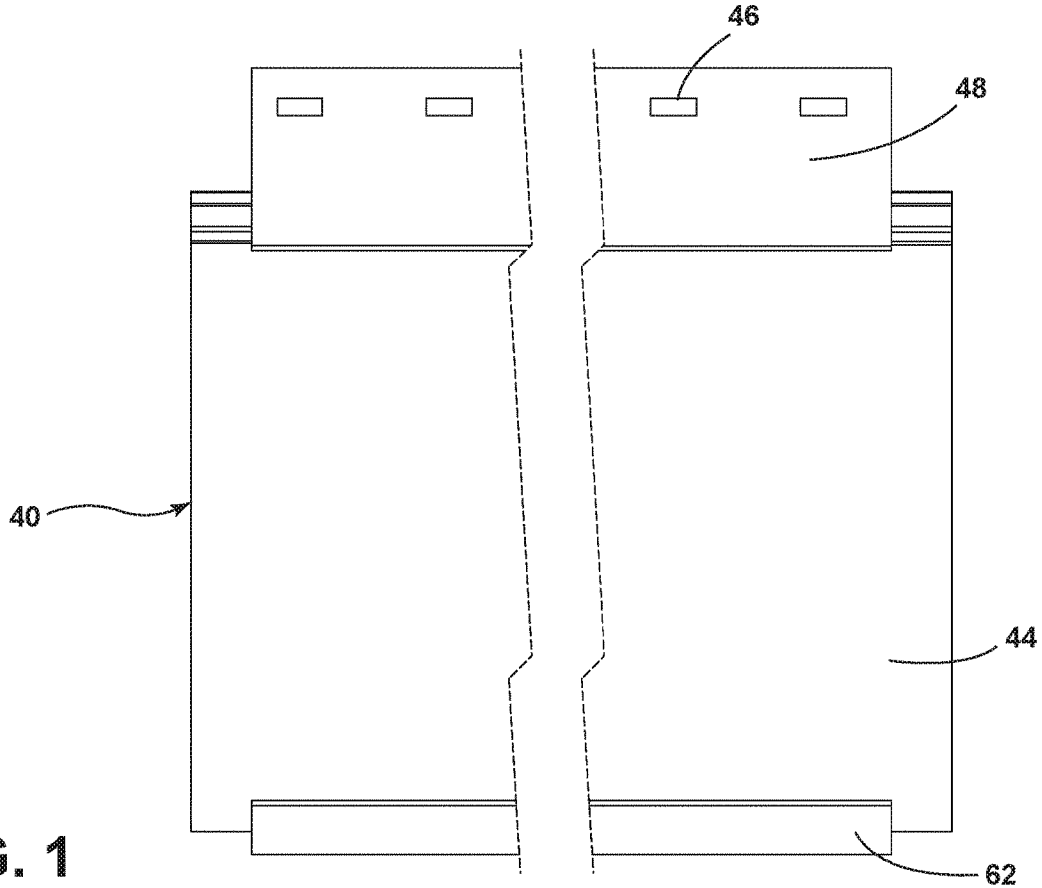
FIG. 1 is a partial rear view of a siding panel according to one embodiment of the present invention.

As referenced in the figures, the same reference numerals may be used herein to refer to the same parameters and components or their similar modifications and alternatives. For purposes of description herein, the terms "upper," "lower," "right," "left," "rear," "front," "vertical," "horizontal," and derivatives thereof shall relate to the present disclosure as oriented in the Figures. However, it is to be understood that the present disclosure may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Figure 2:
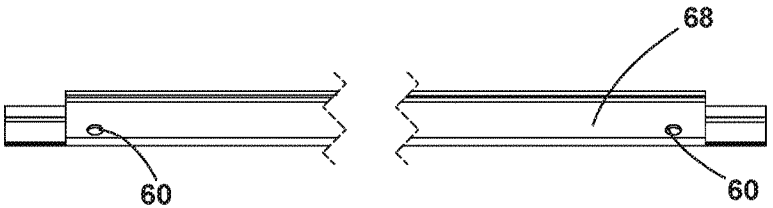
FIG. 2 is a bottom view of the siding panel shown in FIG. 1.
Figure 4:
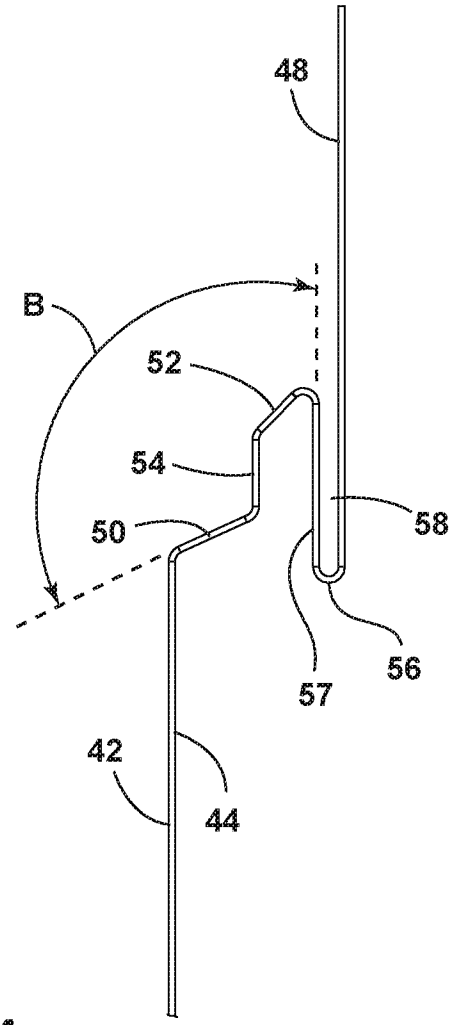
FIG. 4 is an enlarged cross-sectional view of the siding panel shown in FIG. 1, taken along line IV as shown in FIG. 3.
Figure 3:
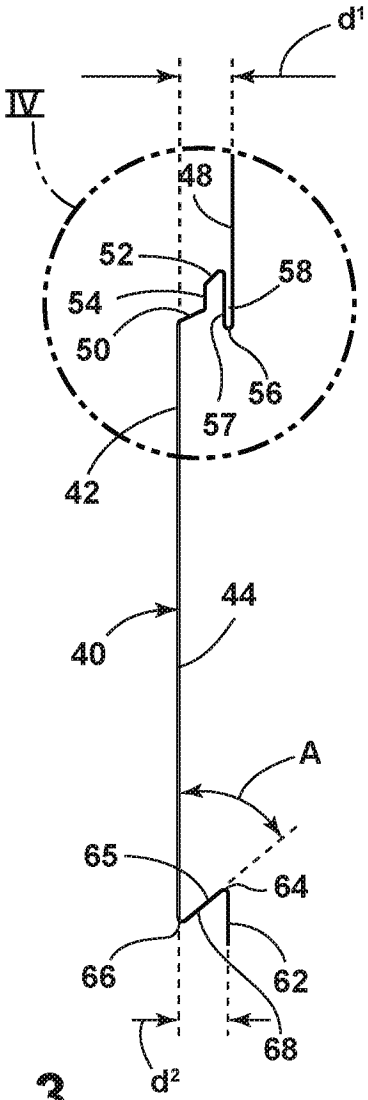
FIG. 3 is a cross-sectional view of the siding panel shown in FIG. 1.
Figure 5:
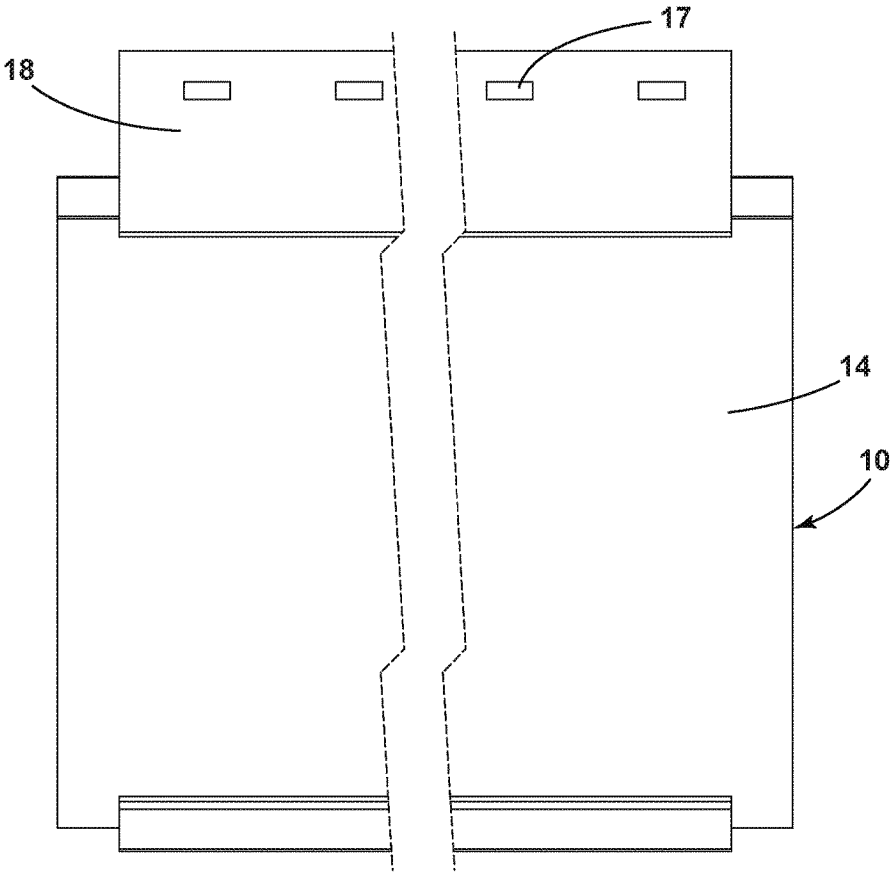
FIG. 5 is a rear view of siding panel according to another embodiment of the present invention.
Figure 6:
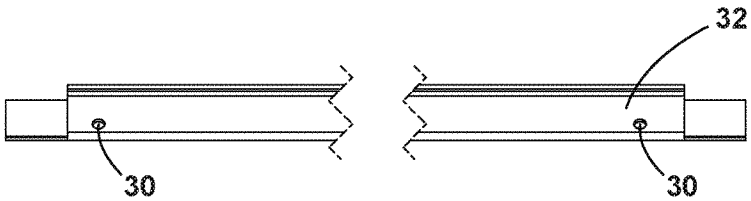
FIG. 6 is a bottom view of the siding panel shown in FIG. 5.
Figure 9:
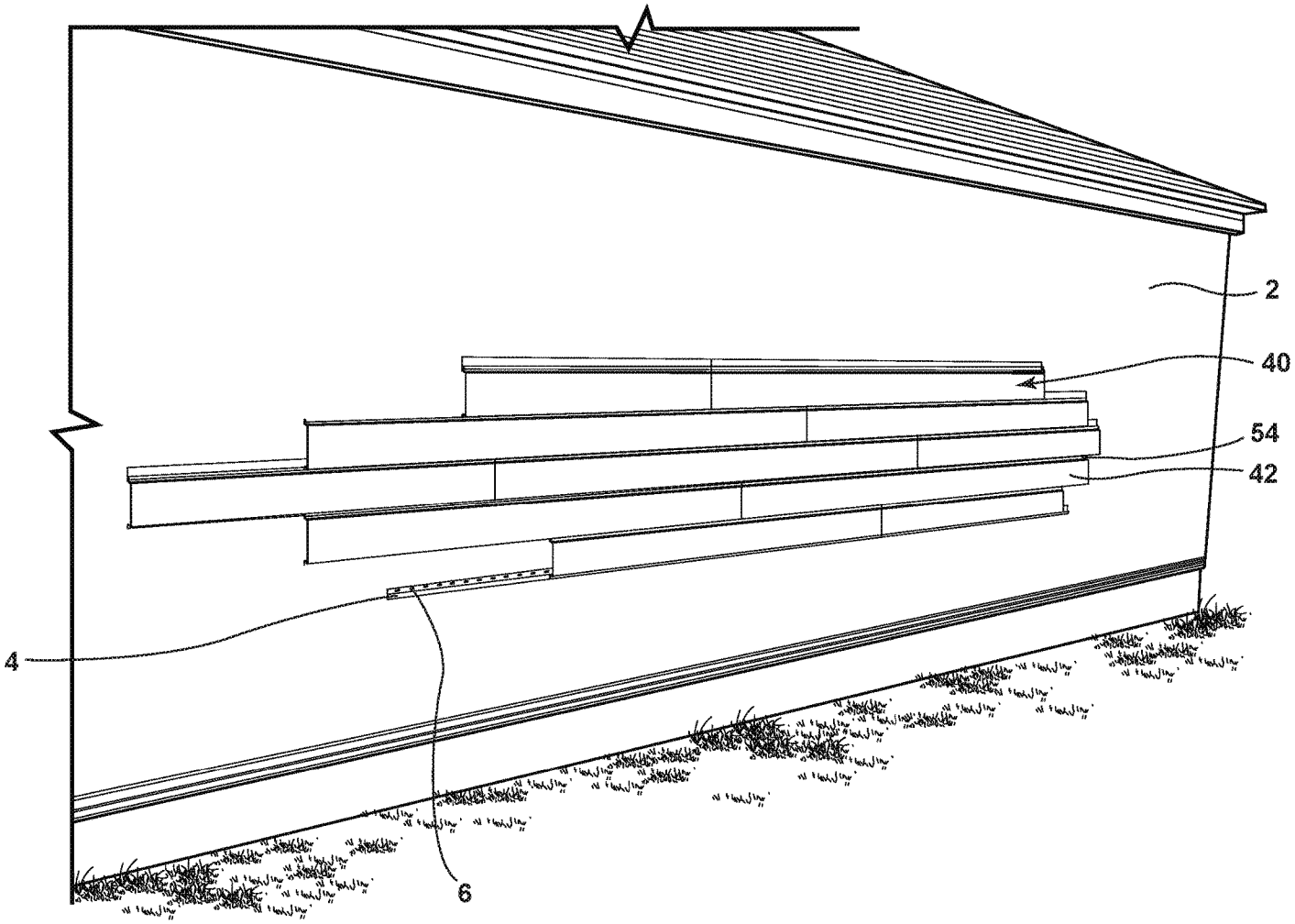
FIG. 9 is a front perspective view of the siding panel shown in FIG. 1, installed on the side of a building.
Figure 10:
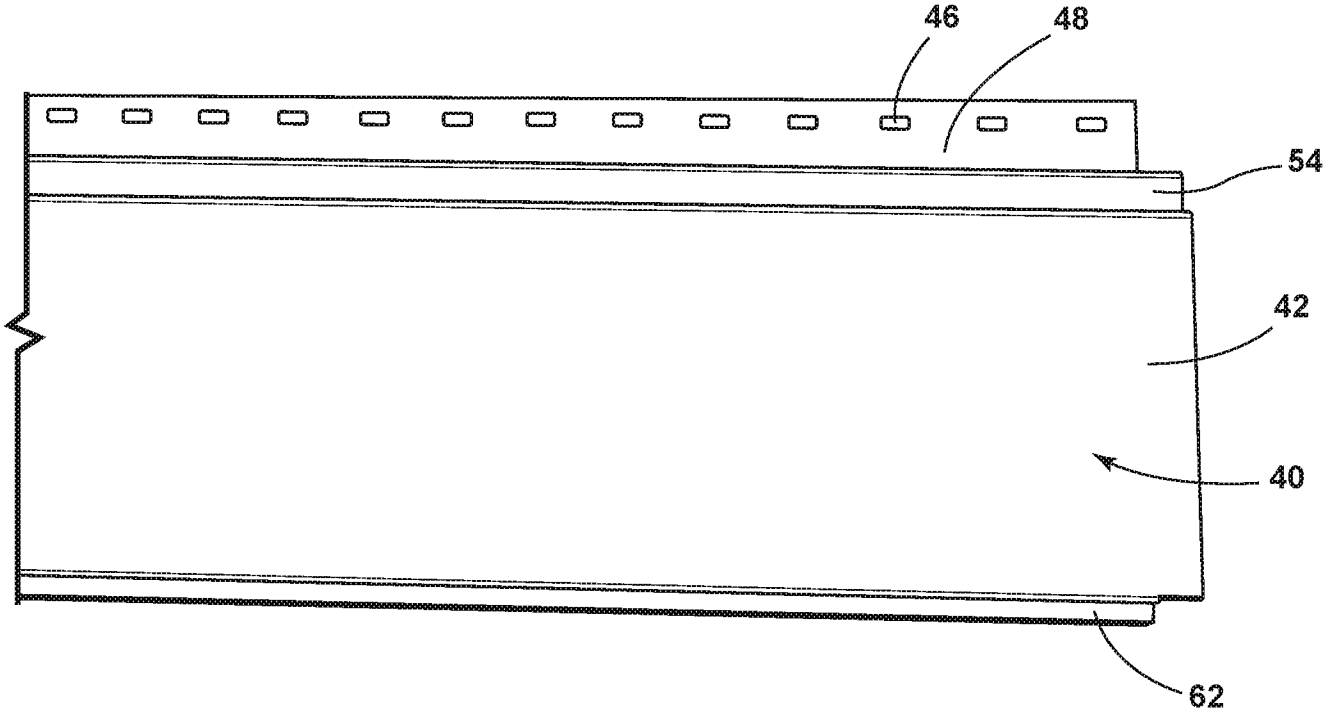
FIG. 10 is a front perspective view of the siding panel shown in FIG. 1.
Figure 11:
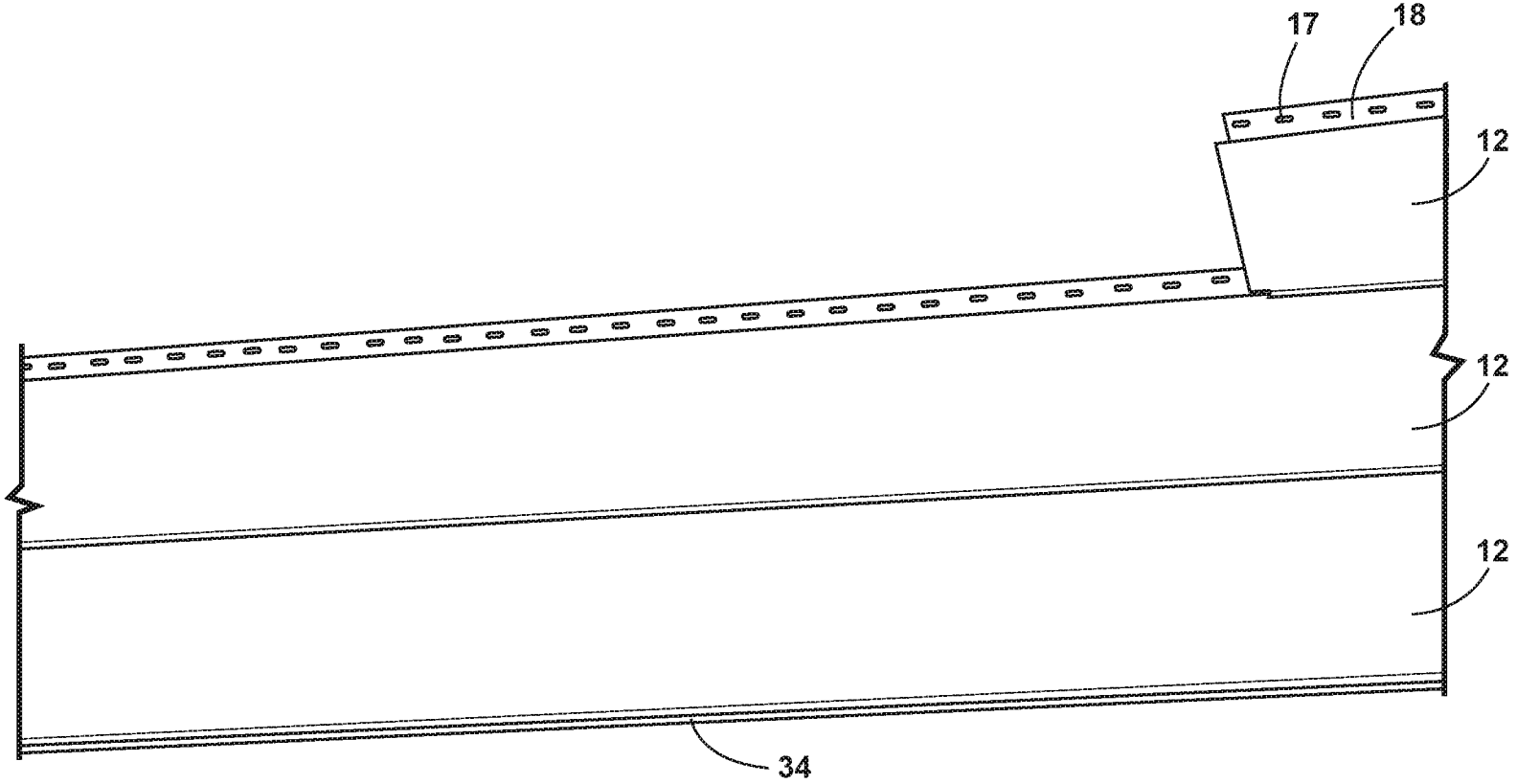
FIG. 11 shows a number of the siding panels of the embodiment shown in FIG. 5 connected together.

As referred to in FIGS. 1-4, an embodiment of a sliding panel 40 is shown. The siding panel 40 includes an inner face 44 and an outer face 42, as shown in FIG. 3. The siding panel 40 is an elongated panel that will be installed in a generally horizontal fashion, as illustrated in FIG. 9. The siding panel 40 includes a securing flange portion 48 that has a number of fastener openings 46. As illustrated in FIGS. 3 and 4, the securing flange portion 48 is generally parallel to the inner face 44 and outer face 42 of the siding panel 40. A first upper inclined surface 50 extends from the upper end of the elongated body toward the securing flange 48. The embodiment shown in FIGS. 1-4 includes a recessed face portion 54 that is generally parallel to the outer face portion 42 and will be visible when installed, as illustrated in FIG. 9. The upper inclined surface 50 is at an angle B to the recessed face portion 54 of the siding panel 40 of approximately 110° to 120°, and more preferably approximately 115°. A second upper inclined surface 52 extends upwardly from the recessed face portion 54. The siding panel 40 includes a receiving channel 58, which is formed between the securing flange portion 48 and a wall 57 that is generally parallel to both the securing flange portion 48 and the inner face 44 of the siding panel 40. The receiving channel 58 can include a generally U-shaped bottom 56.

The siding panel 40 also includes a tab portion 62. The tab portion 62 extends generally parallel to the inner face 44 and outer face 42 of the siding panel 40. A lower inclined surface 68 extends from the bottom of the siding panel 40 and includes a curved portion 66 where the inclined surface 68 extends from the lower portion of the siding panel 40 and a curve 64 where the inclined surface 68 meets the tab 62. As illustrated in FIG. 3, the angle A between the inclined surface 68 and the inner face 44 is in the range of 40° to 60°, and more preferably 50°.

The inclined surface 68 and the inner face 44 of the siding panel 40 form an inner channel 65, as illustrated in FIG. 3. A plurality of weep holes 60 are located in the inner channel 65, as illustrated in FIG. 2.

Figure 8:
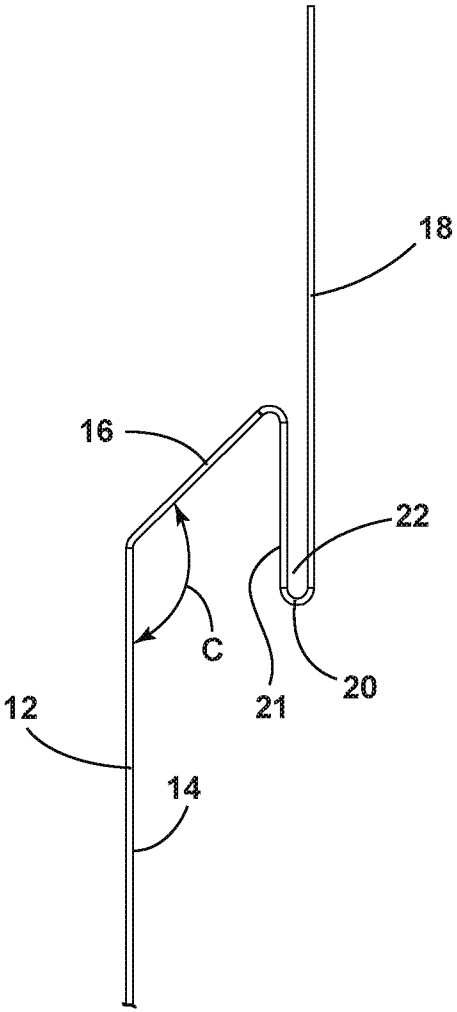
FIG. 8 is an enlarged cross-sectional view of the siding panel shown in FIG. 5, taken along the line VIII as shown in FIG. 7.

Another embodiment is illustrated in FIGS. 5-8. In that embodiment, the siding panel 10 includes an outer face 12 and an inner face 14. An upper inclined surface 16 extends from the upper end of the siding panel 10. As illustrated in FIG. 8, the angle C between the inclined surface 16 and the inner face 14 of the siding panel 10 is in the range of 125° to 145° and more preferably approximately 135°. A securing flange 18 extends vertically and is generally parallel to the inner face 14 and outer face 12 of siding panel 10. A receiving channel 22 is located between the securing flange 18 and a generally vertical wall 21 that is generally parallel to both the securing flange 18 and the inner face 14 of the siding panel 10. The receiving channel 22 can include a generally U-shape bottom 20, as illustrated in FIG. 8.

Figure 7:
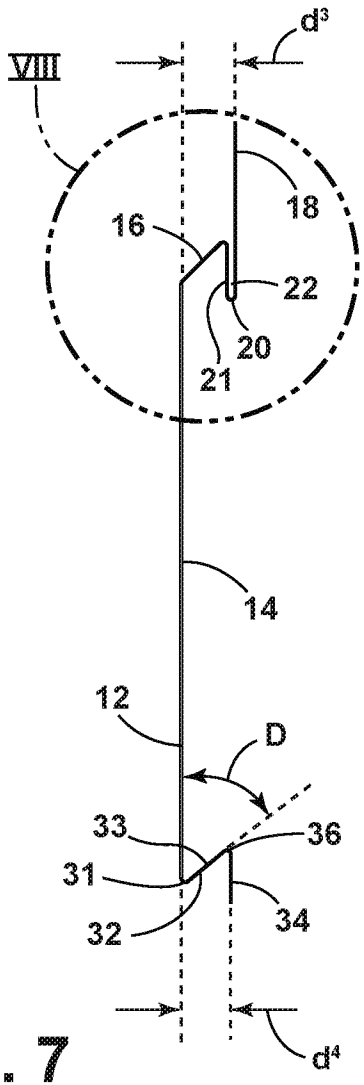
FIG. 7 is a cross-sectional view of the siding panel shown in FIG. 5.

The siding panel 10 has a tab 34 located near the bottom end of the panel 10. As illustrated in FIG. 7, the tab portion 34 is generally parallel to the inner face 14 of the siding panel 10. A lower inclined surface 32 extends from the bottom of the siding panel 10 and connects to the tab portion 34, as illustrated in FIG. 7. A curved portion 31 exists where the siding panel 10 transitions from the outer face portion 12 to the lower inclined surface 32. Similarly, a curved portion 36 exists where the siding panel 10 transitions from the inclined portion 32 to the tab portion 34. The angle D between the inner face 14 and the lower inclined surface 32 is in the range of 40° to 60°, and more preferably approximately 50°.

As illustrated in FIG. 3, the distance d' between the outer face 42 of the siding panel 40 and the tab portion 58 is greater than the distance $d^2$ between the outer face 42 and the tab portion 62. For example, $d^1$ could be approximately 0.46 inches, while $d^2$ is approximately 0.40 inches. Similarly, in the embodiment shown in FIG. 7, the distance between the outer face 12 and the tab portion 18 $d^3$ is greater than the distance $d^4$ between the outer face 12 and the tab portion 34. For example, $d^3$ could be approximately 0.46 inches, while $d^4$ is approximately 0.40 inches. The difference in distances could be in the range of 0.01 to 0.12 inches, with a preferred distance of approximately 0.06 inches.

Figure 12:
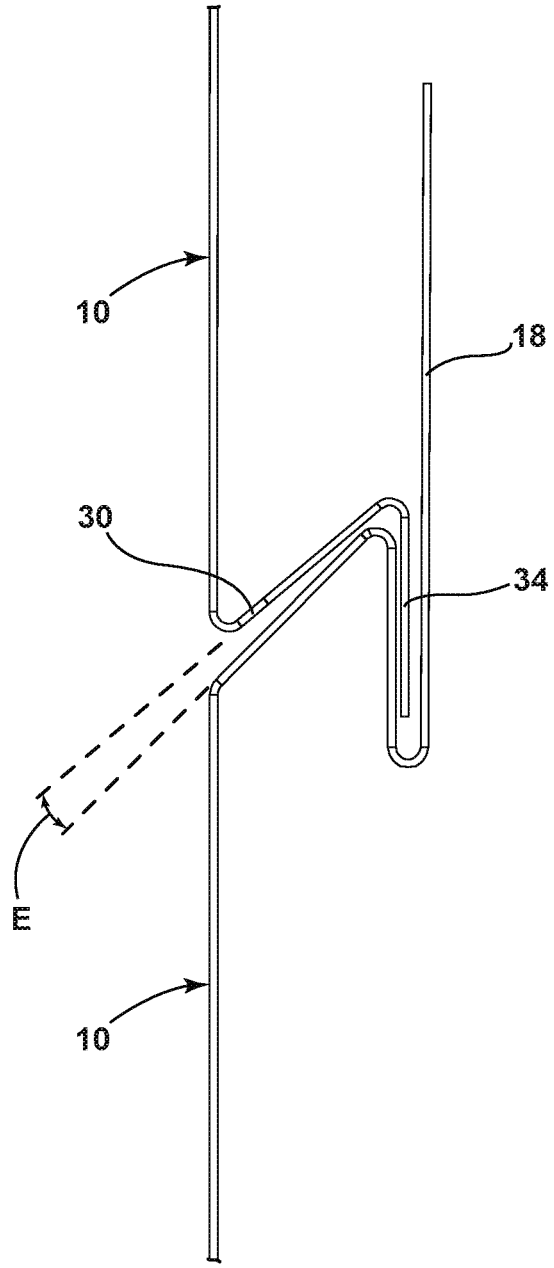
FIG. 12 is a partial enlarged cross-sectional view of two siding panels of FIG. 5.

As illustrated in FIG. 12, when an adjacent siding panel 10 is installed above an adjacent siding panel 10, the tab portion 34 of the upper siding panel 10 is received by the receiving channel 22 of the lower siding panel 10. In this arrangement, the lower inclined surface 32 of the upper siding panel 10 will be positioned next to the upper inclined surface 16 of the lower siding panel 10. This permits the weep holes 30 to allow any water collected in the inner channel 33 of the upper siding panel 10 to drip onto the upper inclined surface 16 of the adjacent lower siding panel 10. The upper inclined surface 16 causes any water that falls onto it from the weep hole 30 of the above siding panel 10 to move away from the surface of the building wall 2. As illustrated in FIG. 12, the difference in angles C and D results in an open angle E that allows air to flow in and out of the weep holes 30.

The tab portion 34 can include an additional hinge portion of material (not shown) that can be compressed when the tab 34 is placed into the receiving channel 20 of an adjacent siding panel 10. The hinge portion can be attached, for example, to the lower portion of the tab 34 and extend upwardly at a slight angle away from the tab portion 34. The tab portion 34 can also be loosely received in the receiving channel 20, as illustrated in FIG. 12.

Similarly, the siding panel 40 with the recessed face 54 can be installed on the side of the building wall 2, as illustrated in FIG. 9. As shown in FIG. 9, a started strip 4, which includes a plurality of fasteners openings 6, can be installed in a generally horizontal manner on the building wall 2. When the panels are installed the recessed face 54 and the outer face 42 of the panels 40 can seen. When that siding panel 40 is installed adjacent to another siding panel 40, the tab portion 62 of the upper siding panel 40 is received in a receiving channel 58 of the lower siding panel 40. The lower inclined surface 68 will be positioned next to the second upper inclined surface 52, permitting the recessed face 54 to be seen when the siding panel 10 is installed. The weep holes 60 will permit water to drip from the inner channel 65 of the upper siding panel 40 onto the first upper inclined surface 50 thereby shedding water away from the building wall 2, to the extent water is accumulated in the inner channel 65.

The siding panels 10, 40 can be made of any material. Preferably, the siding panels 10, 40 are manufactured from a metal material, such as steel or aluminum. The siding panels 10, 40 can be painted and/or coated to appear like a wooden plank. Thus, when the siding panel 10 is installed on a building wall 2, the siding panel 10 will appear to be adjacent planks of wood secured next to one another. However, the siding panel 10 has the benefit of durability, integral water shedding, hidden securing flanges, and customizable color/patterns in the painting and/or coating, providing many advantages over traditional wooden siding products. Similarly, the siding panel 40 with the recessed face 54 can have the similar advantages over wooden planks when installed on a building wall 2, with the added benefit of having a recessed face 54, which gives the appearance of a channeled wood product while maintaining the durability, the customization options with paint, pattern, and color, and with the integral water weeping capability.

As illustrated in the drawings, the panels 10, 40 can be installed horizontally as traditional siding. The panels 10, 40 can also be installed vertically or on angles. The panel 10, 30 can also be used as soffit, as underdecking, or in other overhead arrangements.

Those skilled in the art will recognize, or will be able to ascertain using no more than routine experimentation, many equivalents to the specific embodiments of the invention described herein. Such equivalents are intended to be encompassed by the following claims.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

It will be understood by one having ordinary skill in the art that construction of the present disclosure and other components is not limited to any specific material. Other exemplary embodiments of the disclosure disclosed herein may be formed from a wide variety of materials, unless described otherwise herein.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A siding panel to be attached to a building, comprising:

an elongated body having an inner face and an outer face, comprising:

a securing flange portion near an upper end of the said elongated body, said securing flange portion being generally horizontal when said elongated body is attached to a surface of a building;

said securing flange portion having a plurality of fastener openings;

said securing flange portion being spaced away from said outer face of said elongated body a first distance to space said inner face of said elongated body a distance away from the building when said elongated body is attached to a surface of a building;

a receiving channel located near the bottom of said securing flange;

a tab portion near a lower end of said elongated body, said tab portion being generally horizontal when said elongated body is attached to a surface of a building;

said tab portion being spaced away from said outer face of said elongated body a second distance;

an inner channel formed by a lower inclined surface between said inner face of said elongated body and said tab portion, said inner channel including one or more weep holes;

an upper inclined edge located near the upper end of said elongated body; and wherein said second distance is smaller than said first distance.

2. The elongated siding panel of claim 1, further including:

a recessed face portion located near said upper end of said elongated body, said recessed face portion extending vertically from said upper inclined edge, with a second upper inclined edge extending from said recessed face portion toward said securing flange.

3. The elongated siding panel of claim 2, wherein said receiving channel is formed between a downward extension from said second inclined edge and a portion of said securing flange.

4. The elongated siding panel of claim 2, wherein the angle between said first upper inclined edge and said recessed face portion is in the range of 110° to 120°.

5. The elongated side panel of claim 1, wherein said second distance is approximately 0.01 to 0.12 inches smaller than said first distance.

6. The elongated siding panel of claim 1, wherein the angle between said inner face of said elongated body and said lower inclined surface that forms said inner channel is in the range of 40° to 60°.

7. The elongated siding panel of claim 6, wherein said angle is approximately 50°.

8. The elongated siding panel of claim 1, wherein said tab portion includes a flange that is compressed when said tab portion is placed into a receiving channel of an adjacent elongated siding panel.

9. The elongated siding panel of claim 1, wherein said elongated body is formed from metal.

10. A building siding system, comprising:

a generally vertically extending building wall;

a siding panel having an elongated body with a generally horizontal upper end and a generally horizontal lower end when said siding panel is secured in a generally horizontally orientation to said building wall, said elongated body having an outer face oriented away from said building wall and an inner face oriented toward said building wall;

a securing flange extending from said siding panel with a plurality of fastener openings, said securing flange being spaced away from said outer face of said elongated body a first distance, fasteners secured through said fastener openings to attach said siding panel to said building wall;

a receiving channel, located between a portion of said securing flange and a generally vertical portion of said siding panel spaced away from said securing flange, the bottom of said receiving channel being generally U-shaped;

a tab portion located near said generally horizontal lower end of said elongated body, being spaced away from said outer face of said elongated body a second distance;

an inner channel formed by a lower inclined surface that extends from the bottom of said generally horizontal lower end to the top of said tab portion;

a first upper inclined edge that extends from said generally horizontal upper end toward a portion of said securing flange;

a plurality of weep holes positioned in the lower end of said inner channel; and wherein said second distance is smaller than said first distance.

11. The building siding system of claim 10, wherein the walls of said receiving channel are generally parallel.

12. The building siding system of claim 10, wherein a portion of the walls of said receiving channel are spaced apart the approximate thickness of said tab portion.

13. The building siding system of claim 10, wherein said tab includes a hinged portion that compresses when said tab of one panel is inserted into the receiving channel of an adjacent siding panel.

14. The building siding system of claim 10, wherein said siding panel is metal.

15. The building siding system of claim 10, further including:

a recessed face portion located near said upper end of said elongated body, said recessed face portion extending vertically from said first upper inclined edge, with a second upper inclined edge extending from said recessed face portion toward said securing flange.

16. The building siding system of claim 15, wherein said receiving channel is formed between a downward extension from said second upper inclined edge and a portion of said securing flange.

17. The building siding system of claim 10, wherein said second distance is approximately 0.01 to 0.12 inches smaller than said first distance.

18. A siding panel, comprising:

an elongated body having an upper end, a lower end, an outer face, and an inner face;

a securing flange positioned in a generally parallel manner to said outer face, said securing flange including an upward portion with a plurality of fastener openings that extend vertically parallel to and above said upper end of said elongated body, and a downward portion that extends generally parallel to and below a portion of said upper end of said elongated body;

a receiving channel formed between said downward portion of said securing flange and a wall that is generally parallel to said downward portion of said securing flange to create a channel with a generally U-shape bottom;

a tab portion, positioned in a generally parallel manner to said outer face of said elongated body, said tab portion including an upper end portion that extends generally parallel to and above said lower end of said elongated body, and a lower end portion that extends generally parallel to and below said lower end of said elongated body, wherein said tab is spaced away from said outer face a distance that is less than a distance that said securing flange is spaced from said outer face;

an inner channel formed between a lower inclined surface extending from said lower end of said elongated body to said upper end of said tab portion; and a plurality of weep holes located in said inner channel.

19. The siding panel of claim 18, wherein said elongated body is made from metal.

* * * * *